US005785213A

United States Patent [19]

Guillot

[11] Patent Number: 5,785,213

[45] Date of Patent: Jul. 28, 1998

[54] DEVICE FOR STOPPERING A CONTAINER AND FOR DISPENSING THE PRODUCT WHICH IT CONTAINS

[75] Inventor: Christian Guillot, Maillat, France

[73] Assignee: Etablissements Janvier, Chassal, France

[21] Appl. No.: 681,986

[22] Filed: Jul. 30, 1996

[30] Foreign Application Priority Data

Aug. 11, 1995 [FR] France ..... 95 09900

[51] Int. Cl.[6] ..... B65D 41/32; B65D 51/18; B67D 3/00

[52] U.S. Cl. ..... 222/553; 215/250; 215/354; 220/253; 220/265

[58] Field of Search ..... 215/307, 204, 215/252, 253, 320, 321, 354; 220/253, 351, 345, 255, 256, 711, 713, 703; 222/541.6, 541.9, 553, 554, 548

[56] References Cited

U.S. PATENT DOCUMENTS

| | | | |
|---|---|---|---|
| 3,029,003 | 4/1962 | Gronemeyer | 222/548 |
| 3,149,755 | 9/1964 | Porter et al. | 222/548 |
| 5,161,718 | 11/1992 | Gueret | 222/553 X |
| 5,325,999 | 7/1994 | Gueret | 222/553 X |
| 5,358,146 | 10/1994 | Stull | 222/548 X |

FOREIGN PATENT DOCUMENTS

| | | | |
|---|---|---|---|
| 0 452 196 | 10/1991 | European Pat. Off. . | |
| 2646910 | 4/1978 | Germany | 222/548 |

*Primary Examiner*—Allan N. Shoap
*Assistant Examiner*—Niki M. Kopsidas
*Attorney, Agent, or Firm*—Oliff & Berridge, PLC

[57] ABSTRACT

This device comprises, on the one hand, a stopper fixed to the neck of the container, having a skirt intended to do the fixing to the exterior wall of the container, a central hollow shaft resting against the internal face of the neck of the container and a closed end having an off-centered opening connected to the central hollow shaft by an oblique passage and, on the other hand, a cap which, mounted on the stopper, has an exterior skirt mounted so that it can pivot on the skirt of the stopper, a central hollow shaft engaged in the central hollow shaft of the stopper and in contact therewith, the skirt and the hollow shaft being connected by a closed end including an outlet opening for the product, which opening is situated the same distance away from the axis of rotation as the opening of the stopper, and the hollow shaft including an orifice formed on the same side as the opening in the closed end and at the same height as the oblique passage of the stopper.

8 Claims, 2 Drawing Sheets

FIG. 1

DEVICE FOR STOPPERING A CONTAINER AND FOR DISPENSING THE PRODUCT WHICH IT CONTAINS

BACKGROUND OF THE INVENTION

The subject of the present invention is a device for stoppering a container and for dispensing the product which it contains.

DESCRIPTION OF THE PRIOR ART

In the field of cosmetic products, such as creams or gels, to package these in containers equipped with a stoppering device allowing the product to be dispensed without the need to remove a stopper completely, as is traditionally the case, is known. Such a stoppering device is also known as a dispensing lid.

A known device includes a stopper fixed to the neck of the container by means of a skirt which covers the exterior wall of the container or its neck, this stopper including an orifice formed in its closed end, which orifice may be opened or not by means of a cap mounted such that it can move on the stopper.

Usually, the stoppering device comprises three components, which constitutes a complex embodiment, and it is not simple to use and does not give a perfect seal when in the closed position.

SUMMARY OF THE INVENTION

The object of the invention is to provide a device of simple design and of simple structure, practical to use, and which simultaneously allows the product out easily when in the open position and gives excellent closing-off of the container when the device is in the closed position.

To this end, the device to which it relates comprises, on the one hand, a stopper fixed to the neck of the container, having a skirt intended to do the fixing to the exterior wall of the container or of its neck, a central hollow shaft resting against the internal face of the neck of the container and a closed end connecting the central hollow shaft and the exterior skirt, this closed end having an off-centered opening connected to the central hollow shaft by an oblique passage and, on the other hand, a cap which, mounted so that it can pivot on the stopper about an axis corresponding to that of the hollow shaft, has an exterior skirt mounted so that it can pivot on the skirt of the stopper, a central hollow shaft engaged in the central hollow shaft of the stopper and in contact therewith, the skirt and the hollow shaft being connected by a closed end including an outlet opening for the product, which opening is situated the same distance away from the axis of rotation as the opening of the stopper, and the hollow shaft including an orifice formed on the same side as the opening in the closed end and at the same height as the oblique passage of the stopper.

When the cap is in its closed position, its closed end closes off the outlet orifice for the product which is made in the closed end of the stopper, and the product contained within the container is isolated from the outside at the central hollow shaft of the stopper, whose communication with the oblique passage is closed off by the central hollow shaft of the cap.

In order to get into a position for dispensing the product, all the operator need do is pivot the cap relative to the stopper in order to make the central hollow shaft communicate with the oblique passage and unstop the orifice formed in the closed end of the stopper.

According to a first embodiment, the orifice made in the hollow shaft of the cap extends as far as that free edge of the hollow shaft which is situated on the opposite side to the closed end, while the hollow shaft of the stopper includes a return extending toward the closed end thereof as far as the base of the oblique passage, thus forming, with the hollow shaft of the stopper, an annular space in which the hollow shaft of the cap is engaged.

This feature is advantageous insofar as it simplifies the structure of the hollow shaft of the cap which has a slot extending as far as its free edge situated on the opposite side to the closed end.

In order to improve the sealing of the assembly, and prevent product contained in the volume lying between the stopper and the cap from escaping from the cap when the assembly is in the closed position, the skirt of the cap includes, close to the closed end thereof and on its interior wall, an annular clip resting against the exterior wall of the skirt of the stopper.

In order to preset the rotational travel of the cap relative to the stopper, the closed end of the stopper has, over a sector of a circle, a zone cut away on the same side as the interior of the container, while the closed end of the cap has a finger which, projecting on the closed end of the stopper side is engaged in this cutaway.

The two extreme positions in the pivoting of the cap relative to the stopper are defined by the cap finger coming to bear against the stopper cutaway.

In order to perfect the sealing of the device in the closed position, the closed end of the stopper has, at the same distance from the axis of rotation as the opening in the cap, a stub which is angularly offset relative to this opening and projects on the closed end of the cap side so as to be able to penetrate inside the opening thereof when the device is in the closed position.

In order to make this device easier to manipulate, the cutaway and the stub which are formed in the closed end of the stopper, on the one hand, and the opening and the finger which are formed in the closed end of the cap, on the other hand, are respectively arranged so that when the finger is in a first end-of-travel position in the cutaway, the two openings in the stopper and in the cap face each other and so that, in the other end-of-travel position, the stub of the stopper is engaged in the opening in the closed end of the cap.

In order to prevent the stub protruding from the closed end of the stopper from impeding the manipulation of the cap for changing from the open position to the closed position and vice versa, that wall of the closed end of the cap which points toward the closed end of the stopper has, over an angular sector, a recess in the shape of an arc of a circle intended to house the stub protruding from the closed end of the stopper when the cap is rotated.

According to another feature of the invention, the lower edge of the skirt of the cap has a recess in which a tearable safety tab molded integrally with the stopper is engaged.

BRIEF DESCRIPTION OF THE DRAWING

In any case, the invention will be clearly understood with the aid of the description which follows, with reference to the attached diagrammatic drawing representing, by way of nonlimiting example, one embodiment of this stoppering device.

DESCRIPTION OF THE PREFERRED EMBODIMENT

Figure 1:
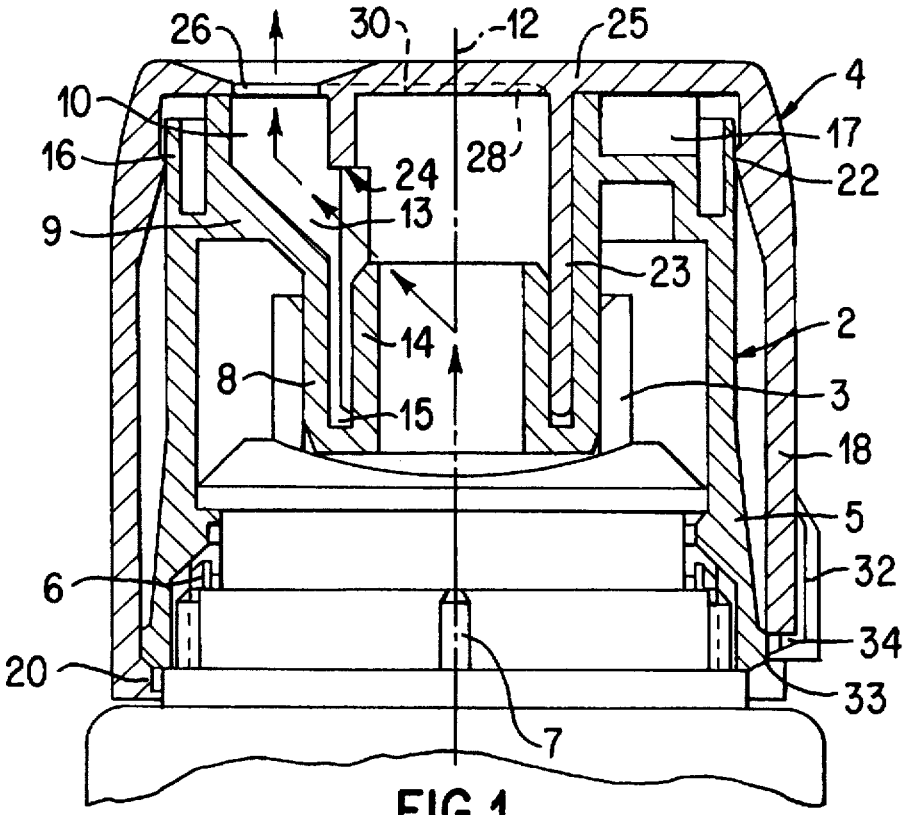
FIG. 1 is a view of it in longitudinal section in the open position.

The stoppering device according to the invention comprises, on the one hand, a stopper 2 made of synthetic material intended to be fixed to the neck 3 of a container, such as a bottle or a tube, and a cap 4 mounted so that it can pivot on the stopper 2. The stopper 2 has a tubular skirt of circular cross section 5 fixed irreversibly to the neck of the container. This fixing is achieved by elastic snap-fastening, with rotational immobilization obtained by means of catches 6 that the skirt of the stopper has interacting with catches 7 formed on the container. The skirt 5 of the stopper includes a central hollow shaft 8 resting against the internal face of the neck 3 of the container, this central hollow shaft 8 being connected to the skirt 5 by a closed end 9. This closed end 9 includes an opening 10 for letting out the product, off-centered relative to the axis 12 of the stopper, the orifice 10 and the hollow shaft 8 being connected by an oblique passage 13. The hollow shaft 8 has a return 14 upward, extending as far as the level of the oblique passage and delimiting, with the main part of the hollow shaft, an annular space 15.

The stopper 2 also includes, in its upper part, an annular zone 16 in the form of a lip extending the skirt 5. Finally, the closed end 9 of the stopper has, over a sector of a circle slightly larger than 90°, a cutaway 17 toward the interior.

Figure 2:
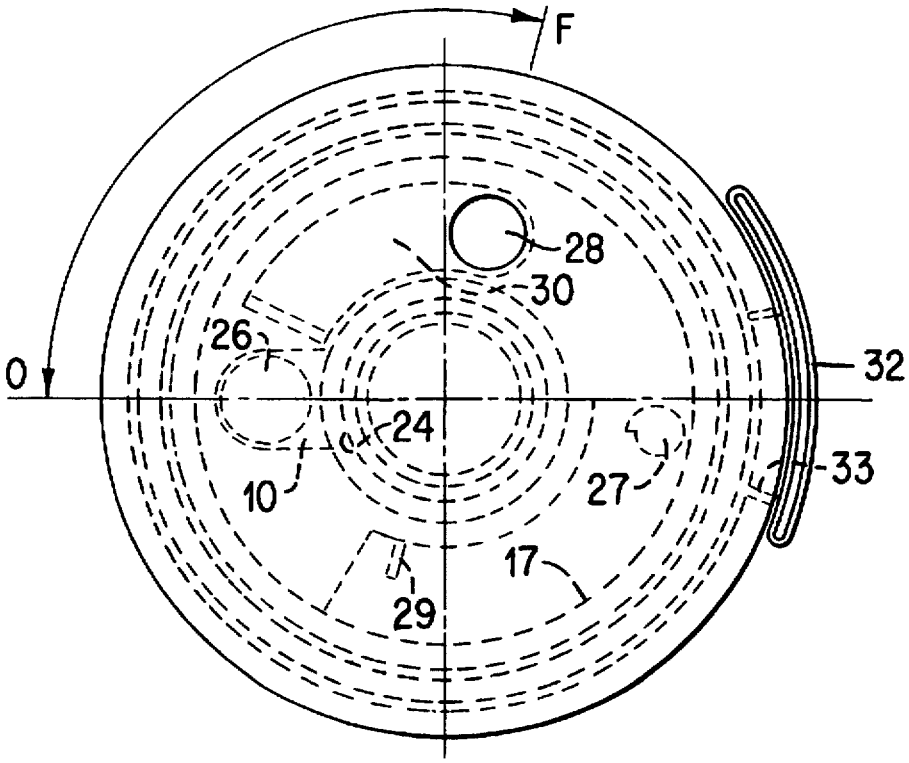
FIG. 2 is a view of it from above in the open position.
Figure 3:
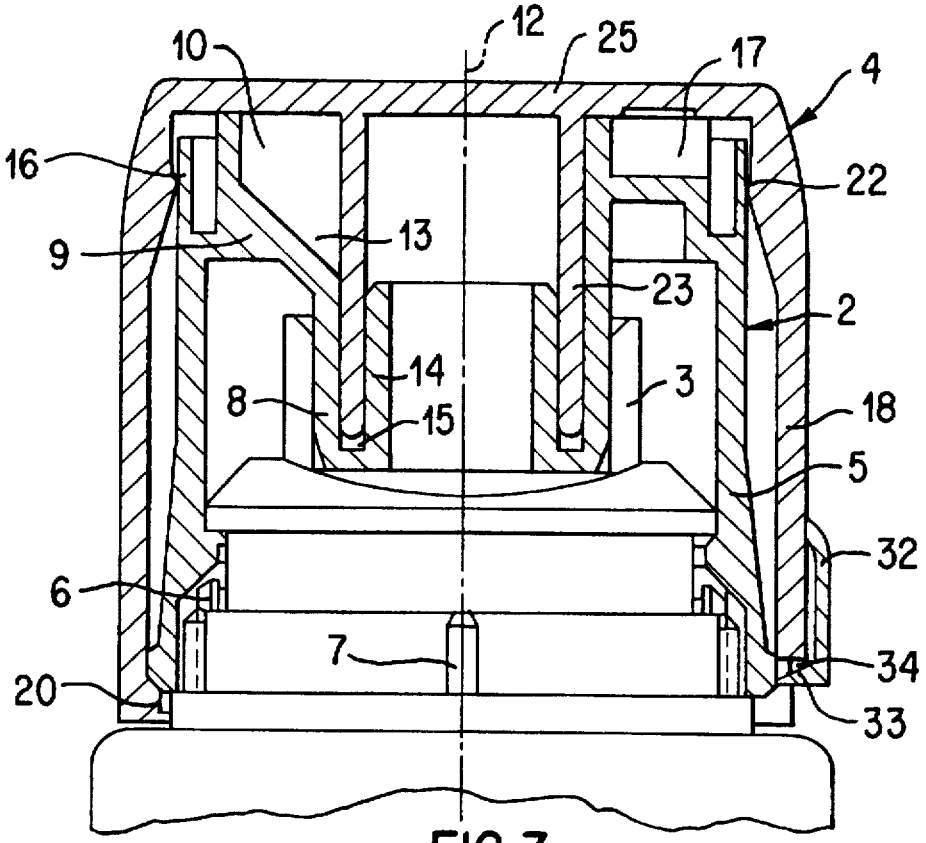
FIGS. 3 and 4 are two views similar to FIGS. 1 and 2 in the closed position.
Figure 4:
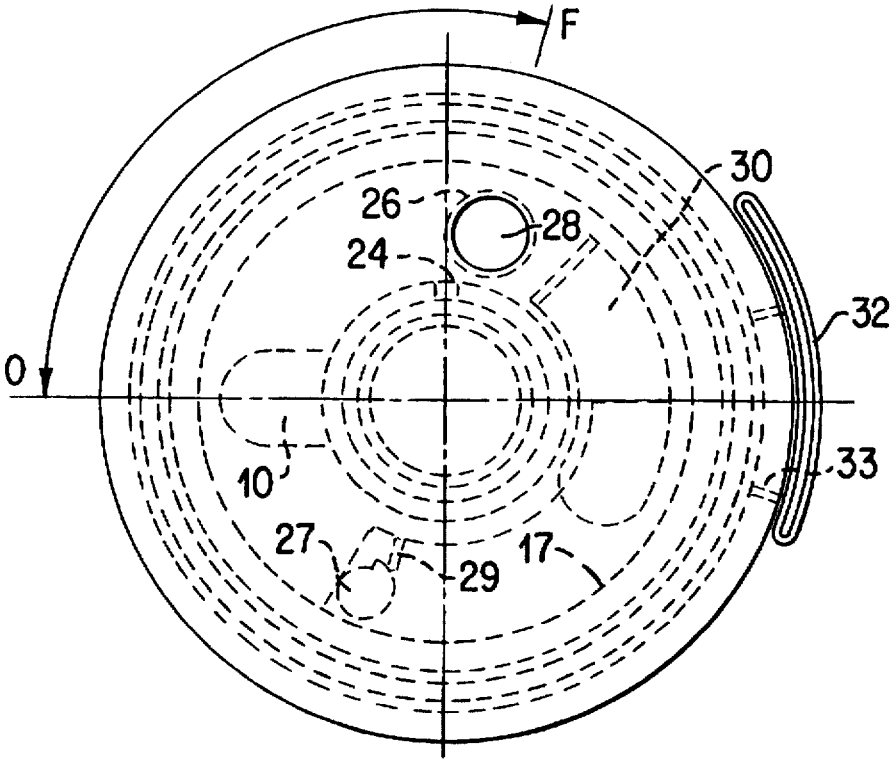

The cap 4 for its part has a cylindrical skirt 18 mounted on the skirt 5 of the stopper so as to be retained axially thereon at its base 20 by virtue of an inward-pointing shoulder that the latter has, and so as to be able to pivot on the skirt 5 of the stopper. At the upper part, the skirt 18 includes an annular clip 22 pointed toward the interior and intended to rest against the sealing lip 16 of the skirt 5 of the stopper. The stopper includes a central hollow shaft 23 engaged in the annular space 15 formed between the hollow shaft 8 and its return 14. This hollow shaft 23 of the stopper includes a lateral opening 24 capable of placing the interior of the container in communication with the oblique passage 13 formed in the stopper. In the embodiment represented in the drawing, this opening 24 is in the form of an elongate slot which stretches as far as the level of the lower edge of the hollow shaft 23. The hollow shaft 23 and the skirt 18 of the cap are connected by a closed end 25 including an opening 26 situated the same distance away from the axis of rotation as the opening 10 of the stopper and having the same angular orientation as the opening 24 formed in the hollow shaft 23. Projecting inward from the closed end 25 is a finger 27 engaged in the cutaway 17 at the closed end of the stopper, this finger being intended to form an end-of-travel stop for the open position and for the closed position respectively by resting against the ends of the cutaway 17, as shown in FIGS. 2 and 4. Finally, the closed end 9 of the stopper has a stub 28 projecting upward, intended to engage in the opening 26 of the closed end of the cap when the device is in the closed position. In order to signal this closure, a pawl 29 secured to the stopper is actuated by the finger 27 of the cap when the latter reaches the closed position. This pawl gives out an acoustic signal making closure audible.

In order to make the movement of manipulating the cap on the stopper easy despite the presence of the stub 28, a recess 30 extending over an arc of a circle is provided in the closed end 25 of the cap, this allowing the stub to be housed during rotational movement except just before the stub 28 penetrates inside the opening 26 in the closed end of the cap. The interruption in the recess at this point makes it possible to prevent accidental opening of the container by unintentional rotation of the cap 4 relative to the stopper 2.

As shown in FIGS. 1 and 2, when the cap is in a first end-of-angular-travel position relative to the stopper, the product contained in the container can come out of this container via the central hollow shaft, the oblique passage 13 and the openings 10 and 26 formed in the closed ends of the stopper and of the cap respectively. When the user wishes to close the container, all he has to do is to rotate the cap 4 in the clockwise direction through an angle of greater than 90° in the embodiment represented in the drawing. This rotation is performed until the finger 27 comes into abutment against the other end of the cutaway 17 as indicated in FIG. 4. In this position, the stub 28 of the closed end of the stopper penetrates inside the opening 26 of the closed end 25 of the cap, and closes it off. At the same time, the hollow shaft 23 of the stopper has pivoted so that it comes and isolates the central hollow shaft from the oblique passage 13. The residual volume of product which may remain in the oblique passage runs no risk of escaping to the outside, bearing in mind that the opening 26 is closed by the stub 28 and bearing in mind the good seal achieved between the skirt 5 of the stopper and the skirt 18 of the cap by means of the sealing lip 16 and of the annular clip 22.

According to another feature, the stopper at its lower edge has a security tab 32 protruding outward and connected to the skirt by a ripable zone 33, at a notch 34 formed in the skirt of the cap. This security tab thus prevents the cap from pivoting relative to the stopper before it has been ripped off the skirt 5, which makes it possible immediately to see whether or not a container has been opened.

As emerges from the foregoing, the invention affords a great improvement to the existing state of the art by providing a stoppering device of simple structure made with just two synthetic material components obtained by molding.

As goes without saying, the invention is not limited to the single embodiment of this device described hereinabove by way of example, but on the contrary encompasses all alternative forms thereof.

I claim:

1. A device for stoppering a container having a neck, and for dispensing the product which said container contains, the device comprising, a stopper fixed to the neck of the container, having a skirt which is fixed to an exterior surface of the container, a central hollow shaft resting against an internal face of the neck of the container and a closed end connecting the central hollow shaft and the exterior skirt, the closed end having an off-centered opening connected to the central hollow shaft along an oblique wall and, a cap which, mounted so that it can rotate on the stopper about an axis corresponding to that of the hollow shaft, has an exterior skirt mounted so that it can rotate on the skirt of the stopper, a central hollow shaft engaged in the central hollow shaft of the stopper and in contact therewith, the skirt and the hollow shaft of the cap being connected by a closed end including an outlet opening for the product, which opening is situated the same distance away from the axis of rotation as the opening of the stopper, and the hollow shaft of the cap including an orifice formed on the same side as the opening in the closed end and at the same height as the oblique wall of the stopper to form an oblique passage.

2. The stoppering device as claimed in claim 1, wherein the orifice made in the hollow shaft of the cap extends as far as a free edge of the hollow shaft of the cap which is situated on the opposite side to the closed end, while the hollow shaft of the stopper includes a return extending toward the closed end thereof as far as the base of the oblique passage, thus forming, with the hollow shaft of the stopper, an annular space in which the hollow shaft of the cap is engaged.

3. The stoppering device as claimed in claim 1, wherein the skirt of the cap includes, close to the closed end thereof and on an interior wall, an annular clip resting against an exterior wall of the skirt of the stopper.

4. The stoppering device as claimed in claim 1, wherein the closed end of the stopper has, over a sector of a circle, a zone cut away on the same side as the interior of the container, while the closed end of the cap has a finger which, projecting on the closed end of the stopper side is engaged in this cut-away.

5. The stoppering device as claimed in claim 4, wherein the closed end of the stopper has, at the same distance from the axis of rotation as the opening in the cap, a stub which is angularly offset relative to this opening and projects on the closed end of the cap side so as to be able to penetrate inside the opening thereof when the device is in the closed position, and wherein the cutaway and the stub which are formed in the closed end of the stopper, and the opening and the finger which are formed in the closed end of the cap, are respectively arranged so that when the finger is in a first end-of-travel position in the cutaway, the two openings in the stopper and in the cap face each other and so that, in a second end-of-travel position, the stub of the stopper is engaged in the opening in the closed end of the cap.

6. The stoppering device as claimed in claim 1, wherein the closed end of the stopper has, at the same distance from the axis of rotation as the opening in the cap, a stub which is angularly offset relative to this opening and projects on the closed end of the cap side so as to be able to penetrate inside the opening thereof when the device is in the closed position.

7. The stoppering device as claimed claim 6, wherein that wall of the closed end of the cap which points toward the closed end of the stopper has, over an angular sector, a recess in the shape of an arc of a circle intended to house the stub protruding from the closed end of the stopper when the cap is rotated.

8. The stoppering device as claimed in claim 1, wherein the lower edge of the skirt of the cap has a recess in which a ripable safety tab molded integrally with the stopper is engaged.

* * * * *